US005555758A

United States Patent [19]

Ellison et al.

[11] Patent Number: 5,555,758

[45] Date of Patent: Sep. 17, 1996

[54] METHOD AND APPARATUS FOR CUTTING COILED WIRE

[75] Inventors: Michael S. Ellison; Antony G. Hudson, both of Bradford, United Kingdom

[73] Assignee: Ellison Circlips Group Limited, Bingley, United Kingdom

[21] Appl. No.: 387,809

[22] PCT Filed: Aug. 25, 1993

[86] PCT No.: PCT/GB93/01816

§ 371 Date: Feb. 27, 1995

§ 102(e) Date: Feb. 27, 1995

[87] PCT Pub. No.: WO94/05445

PCT Pub. Date: Mar. 17, 1994

[30] Foreign Application Priority Data

Aug. 27, 1992 [GB] United Kingdom ..... 9218247

[51] Int. Cl.[6] ..... B21F 11/00; B21F 3/02; B21D 11/14

[52] U.S. Cl. ..... 72/132; 72/135; 72/129; 72/371

[58] Field of Search ..... 470/163; 140/88; 83/907, 638, 627; 72/132, 135, 129, 337, 371

[56] References Cited

U.S. PATENT DOCUMENTS

| | | | |
|---|---|---|---|
| 1,560,228 | 11/1925 | Garrett | 470/163 |
| 1,839,828 | 1/1932 | Booth . | |
| 2,130,324 | 9/1938 | Monahan . | |
| 2,948,322 | 8/1960 | Cox | 72/132 |
| 3,086,228 | 4/1963 | Mellowes | 72/132 |
| 3,581,368 | 6/1971 | Gilvar . | |
| 3,906,768 | 9/1975 | Papa, Jr. | 72/132 |
| 4,365,492 | 12/1982 | Kortan et al. | 72/132 |

FOREIGN PATENT DOCUMENTS 2321349 3/1977 France .

*Primary Examiner*—Lowell A. Larson
*Assistant Examiner*—Rodney Butler
*Attorney, Agent, or Firm*—Cushman Darby & Cushman

[57] ABSTRACT

A length of wire is introduced to a coiling station to form a wire coil which then is fed to a cutting station where the free end of the coil engages a stop. Cutting means sequentially move between non-cutting and cutting positions to cut rings from the coil. The rings are displaced from the cutting station onto a support which includes a portion which receives the gaps in the rings to prevent tangling of the rings.

9 Claims, 5 Drawing Sheets

METHOD AND APPARATUS FOR CUTTING COILED WIRE

FIELD OF THE INVENTION

The present invention relates to an improved method and apparatus for cutting coiled wire. The invention is applicable with particular advantage to the production of circlips.

Circlips are components used in a wide variety of industries and methods have been developed over the years for the mass production of such circlips. In most cases however the circlip is an important component which has to be accurately machined and treated to ensure the correct parameters of shape, dimension, strength and resilience. Thus, any method of production of a circlip depends not only on the creation of the shape but also on the further processing of the circlip.

The shape of a circlip is generally a split annulus where the annular member is generally planar. Most circlips are not exactly annular since they are designed to have a slightly different shape. However, they can be regarded as approximating to a ring. In the present specification, the term "ring" will be used to cover generally annular members, split annular members and split substantially annular members such as circlips. It is also intended to encompass in its broadest sense a piece cut from a coil which describes over more than 360 degrees.

Traditionally, there are two methods of production of circlips. For smaller circlips of diameter up to around 30 mm, for example, the circlips are pressed out of a steel strip. Most circlips having a diameter greater than 30 mm are created from coiled wire.

When a circlip is formed from coiled wire, once the ring has been cut from coil, the ring has to undergo many treatments. A major problem occurring in circlip manufacture is the tangling of circlips and expensive machinery has been developed to untangle the circlips after treatment. The need for such equipment can be avoided if throughout the production process the circlips can be kept aligned and parallel to one another in a batch. In this way a batch of circlips can be treated together.

One method of producing circlips from wire known at present is to take a length of wire and form a coil from it (the coil could be for example 1.5 m long); then to stop the coiling machine and to make one longitudinal cut along the length of the coil thus splitting the coil into a plurality of rings lying parallel and aligned to one another. The batch of rings can then be pushed on to a support to retain the rings in an orderly arrangement for further processing. The disadvantage of using this method is that it is slow since the method of production of the coil has to be stopped.

An alternative method which involves complex synchronisation is to operate a coiling means via a stepper motor which forms one ring and then stops; a cutting machine then operates to slice one ring off which drops away from the cutting station and the coiling machine then operates again. The formed rings fall beneath the cutting machine in a pile. They are then subject to tangling, which results in time consuming untangling being required.

SUMMARY OF THE INVENTION

According to the invention, there is provided a method of forming a plurality of aligned rings from a length of wire, in which:

wire passes through a continuously operating coiling station to form a coil about a longitudinal axis;

the free end of the wire describes a helical path about the longitudinal axis and in the direction of the longitudinal axis away from the coiling station until the free end of the wire abuts a stop so arresting further movement of the free end of the wire;

a blade moves from a first retracted position to a second cutting position to cut the coil to form a ring;

the blade then retracts to allow the newly cut free end of the wire to progress forwards in a direction away from the coiling station;

wherein the stop is arranged such that the newly cut ring may be pushed by the free end of the wire forward in a longitudinal direction to be supported and then fed to a further processing station.

Apparatus for forming a plurality of aligned rings from a length of wire comprising:

a coiling station which includes a wire inlet for receiving a length of wire, and operates to form a coil about a longitudinal axis which is fed from the coiling station such that the free downstream end of the wire describes a helical path about the longitudinal axis and in the direction of the longitudinal axis and, a cutting station downstream of the coiling station including a stop spaced from the coiling station whereby in use a plurality of turns of coil lie between the coiling station and the stop, the cutting station also including a retractable blade movable from a cutting position to a non-cutting position where further movement of the free end of the coil can take place and a support extending in a longitudinal direction from the region of the stop in a downstream direction; whereby a coil formed by the coiling station progresses forwards in a longitudinal direction until the free end of the wire abuts the stop whereupon the blade moves to its cutting position to cut a ring, The blade retracts to a non-cutting position whereupon the newly cut free end of the coil moves forward along its helical path urging the cut ring forwards to be supported by the support for feeding to a further processing station.

In this way, the coiling station can operate continuously and never has to be halted. The resilience of the coiled wire allows the front free end of the coil to be held to arrest its movement whilst further coil formation occurs.

Once the restriction of movement is released, the tension in the coil pushes the free end forwards to quickly push the free end on to the stop so that a new cut can take place.

The stop may be retractable with the blade to allow the unrestricted movement forwards of the cut ring. However, in the case where the ring being formed is a circlip where there is a split formed in the ring, it is preferred that the stop is a thin member over which the cut in the ring can slip once the cut has taken place.

The blade may be arranged in a number of directions and it is possible that the blade can be arranged to move in a direction perpendicular to the longitudinal axis. However, it is preferred that the cut takes place in the direction of the longitudinal axis so that the cut is made through the flat annular face of the ring rather than against the circular edge.

It is further preferred that the blade also serves as the stop. If the blade which retracts is in the form of a thin member which reciprocates in a longitudinal direction, the side of the blade can form the stop. When a cut has taken place, the cut will allow the ring to be pushed over the stop.

More preferably, the cut in the wire is achieved by a shear action where the reciprocating blade cuts against a fixed blade to create a scissor effect.

In this event, once a cut has taken place, the new free end of the wire may be retained by the fixed blade. Thus preferably, a pusher member is mounted adjacent the fixed blade and mounted to move with the retractable blade such that on retraction of the blade from its cutting position, the pusher pushes the free end of the coil past the fixed blade so that it can then freely wind towards the stop.

Preferably, the movement of the retractable blade is controlled by a cam created by the blade having an inclined cam surface which cooperates with an inclined cam surface of a cam which moves in a direction perpendicular to the longitudinal axis. This cam can be driven by a ram to create a force to push the retractable blade. The ram may be mechanical or hydraulic. It is preferred that the cutting mechanism is mounted such that the ram is mounted above the coil and the movement of the cam is in a substantially vertical direction. Preferably, the cutting takes place on the upstroke of the ram thus allowing accurate control of the movement and reducing stress on the mechanisms.

In order to ensure correct timing of the operation of the blade, the apparatus preferably includes a sensor linked to a microprocessor controlling the ram, The sensor senses when the free end of the coil meets the stop. The sensor could be an optical sensor but preferably is one which detects contact between the coil and stop.

The tension in the coil may tend to throw the gap cut in the coil off centre. Preferably therefore the apparatus includes a gap straightening block which bears against the coil and the cut rings to keep them aligned.

BRIEF DESCRIPTION OF THE DRAWINGS

Two examples of apparatus for cutting a coil and a method of using such apparatus will now be described by way of example only with reference to the accompanying drawings, in which.

DESCRIPTION OF THE PREFERRED EMBODIMENT

Figure 4:
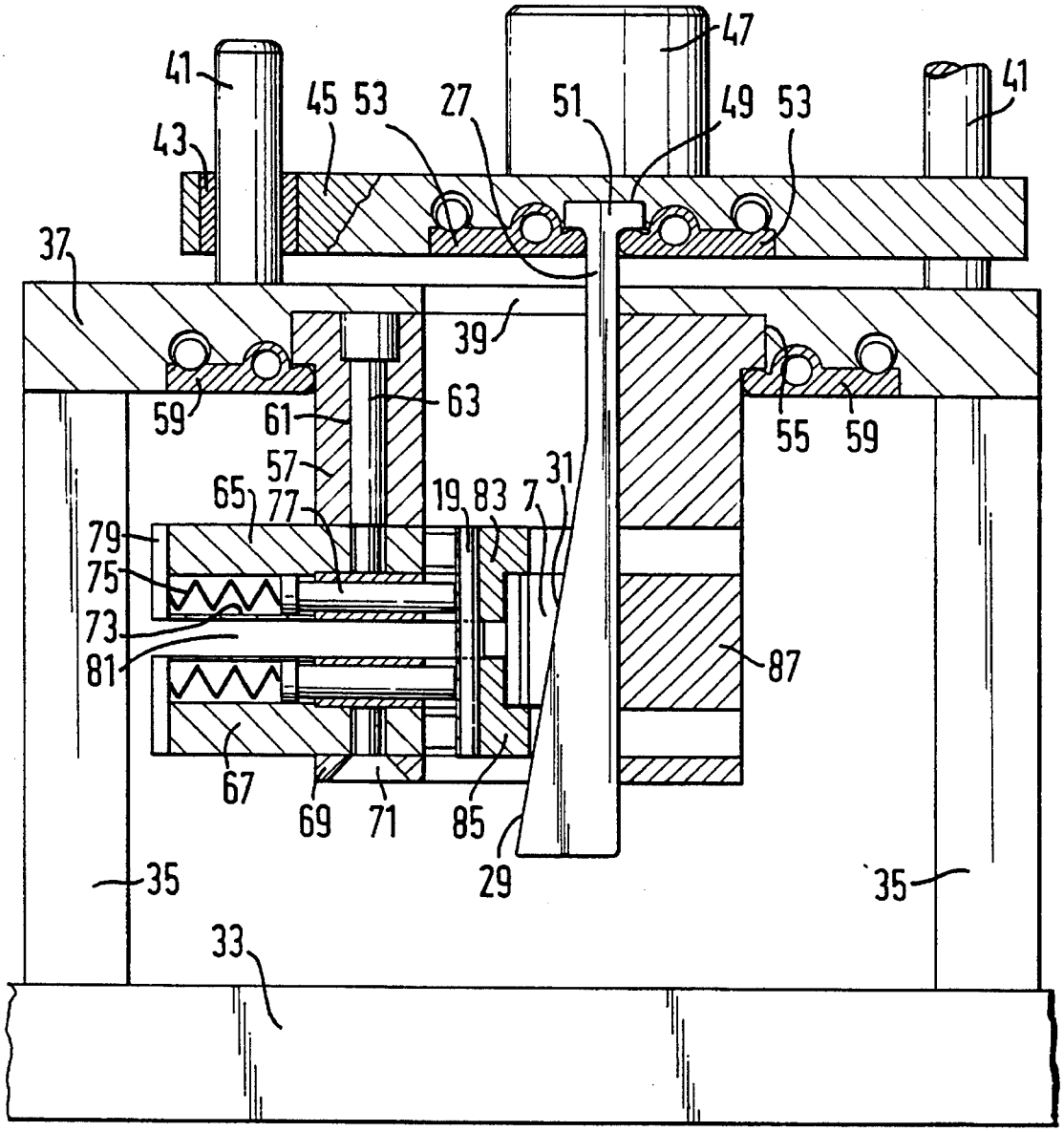
FIG. 4 is a section through a first apparatus for cutting a coil of wire in a first stage of operation.
Figure 5:
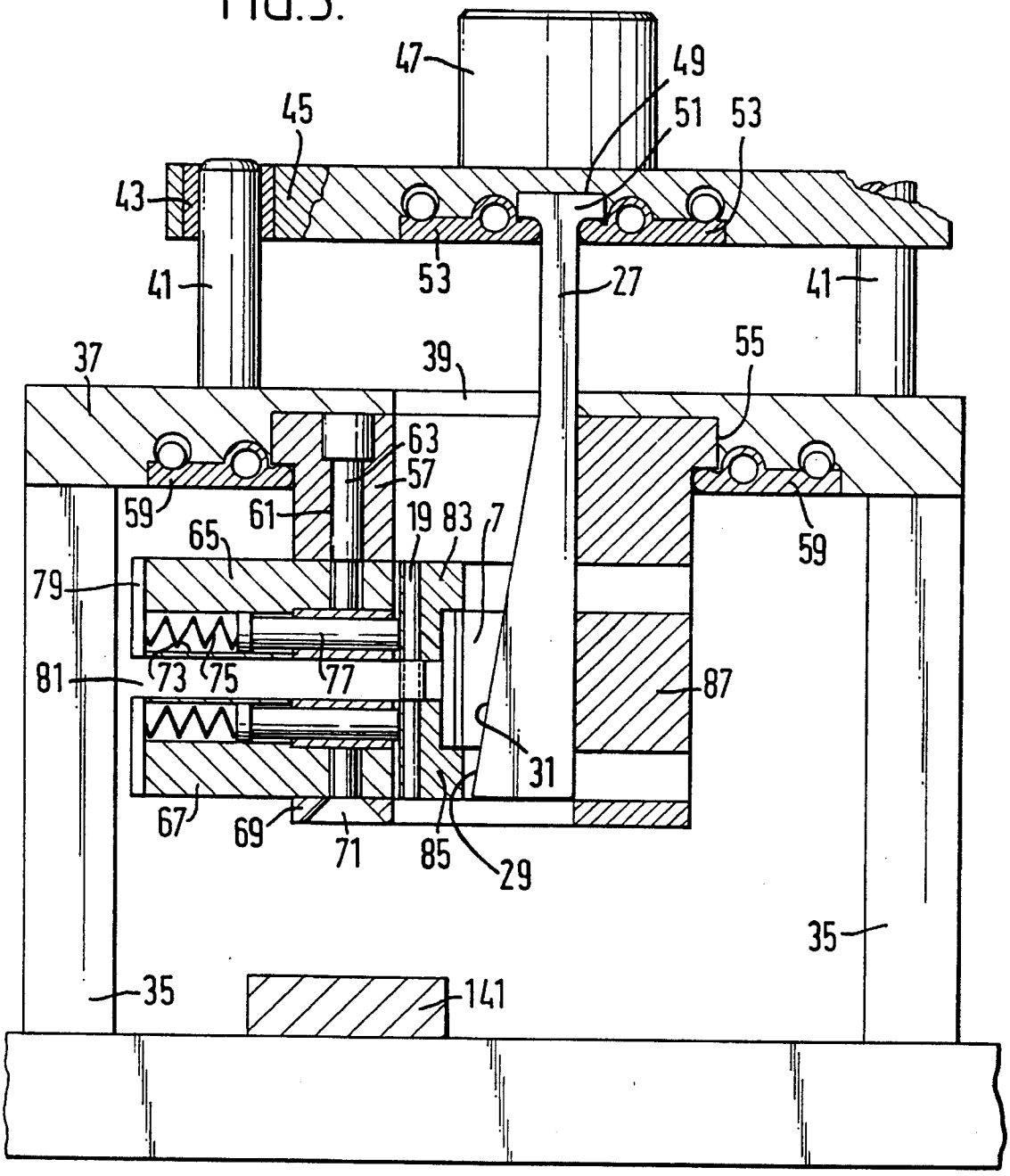
FIG. 5 is a section through a second embodiment of the present invention in a second stage of the operation.

The two embodiments of the apparatus shown in FIGS. 4 and 5 differ only in the dimensions of some of the elements since they are intended to handle coils of different diameter and thickness. In all other respects the apparatus are identical and thus the reference numbers used in each drawing are the same.

Figure 1:
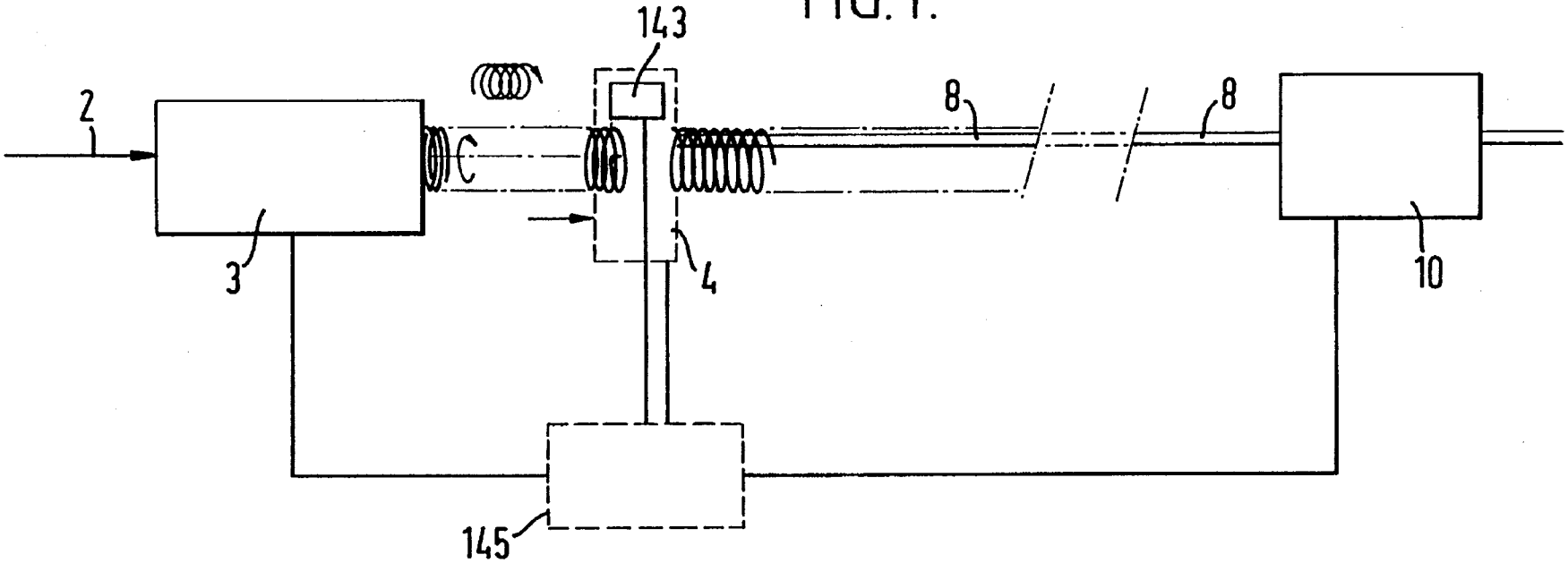
FIG. 1 is a schematic section of the present invention.

The coiling station is not depicted in any detail but is shown as 3 in FIG. 1. Coiling stations are known and the choice of such coiling mechanism will be readily apparent to one skilled in the art.

Figure 6:
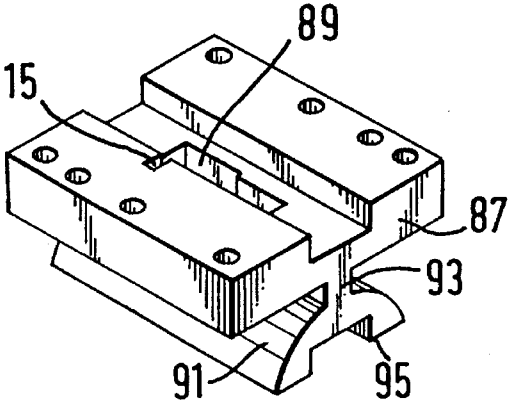
FIG. 6 is an enlarged perspective view of a component of the apparatus.
Figure 2:
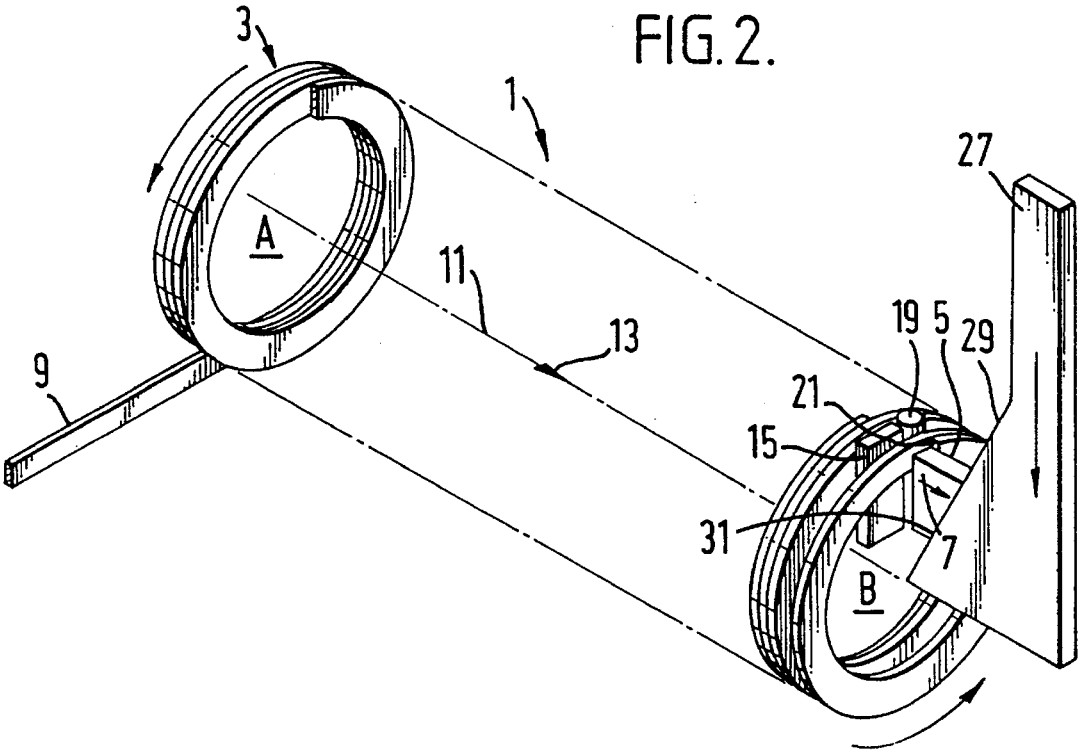
FIG. 2 is a schematic perspective illustration of a first embodiment of the present invention in a first stage of operation.
Figure 3:
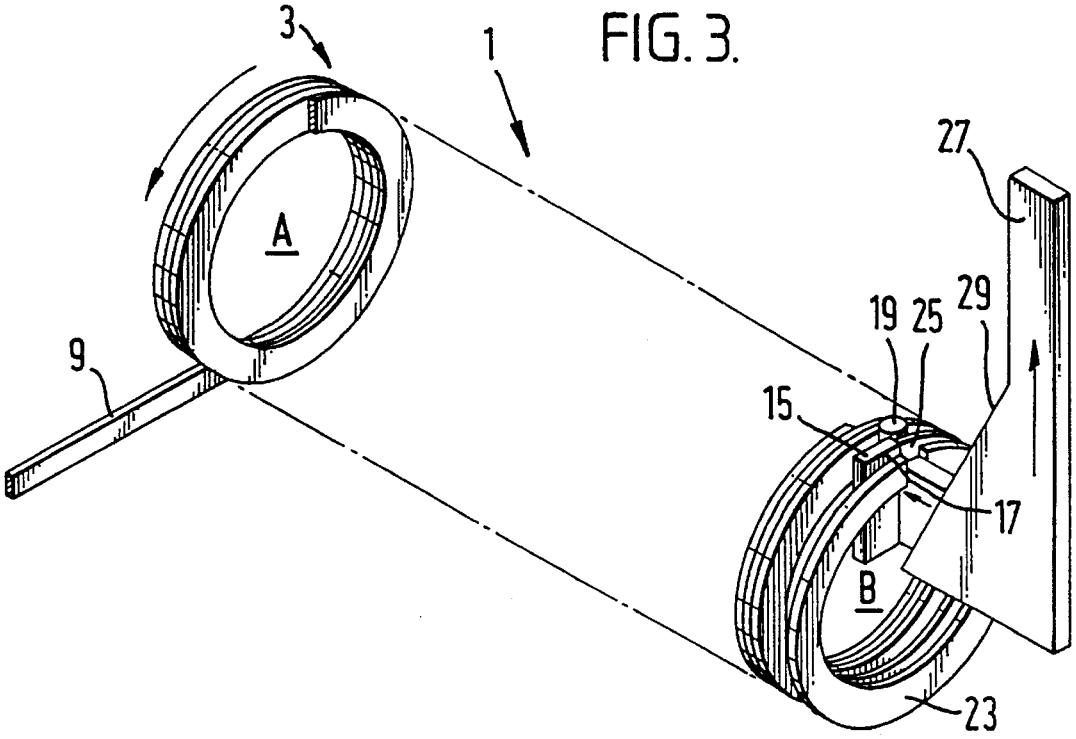
FIG. 3 is a schematic perspective illustration of a second stage of operation of the invention.

Thus, referring to FIGS. 1–3, apparatus 1 comprises a coiling station generally referenced 3, a wire inlet 2, a cutting station 4, a stop 5, a retractable blade 7 and a support depicted generally as 8 in FIG. 1, not shown in FIGS. 2 and 3 but depicted in FIGS. 4 and 5 and shown in more detail in FIG. 6.

Wire 9 is fed to the coiling station 3 which operates continuously to form a coil about a longitudinal axis which feeds the coil in a direction away from the coiling station 3 in a direction along the longitudinal axis. In FIGS. 2 and 3 of the drawings the coiling station can be seen to be forming a coil in an anti-clockwise direction about a longitudinal axis depicted schematically as 11. Wire is fed generally in a direction from A to B and "downstream" is here in the direction of arrow 13.

The stop 5 is formed by the edge of blade member 7 which is retractable in a longitudinal direction as depicted by the arrow. The cutting is effected by a scissor action between retractable blade 7 and fixed blade 15. The edge 7 of the retractable blade moves against the edge 17 of the fixed blade 15 to form a cut in the coil. Pusher means 19 is in the form of a roller having an axis generally perpendicular to longitudinal axis 11. The operation of the apparatus is that the free end 21 of the coil feeds past fixed blade 15 and roller 19 until it abuts face 5 of the blade 7. This arrests of the movement of the front end of the coil whilst the coiling station 3 continuously operates.

The blade 7 then moves from the position shown in FIG. 2 in a backwards direction as shown in FIG. 3 to work with fixed blade 15 to cut the coil to form a ring 23. When the blade 7 moves the roller 19 also moves with it.

The blade 7 then returns to its position shown in FIG. 2 and the roller 19 also moves thus pushing the newly cut free end of the coil 25 forwards and past the fixed blade 15. The tension in the arrested end 25 of the coil is released and pushes the coil quickly in an anti-clockwise direction until the free end encounters the stop 5 formed by the face of the blade 7. This serves to push the newly cut ring in a forwards direction. The thickness of the cut allows the split in the circlip to pass over the stop until it encounters the support shown in FIG. 6 to move it to further processing stations (not shown in detail but referred to generally as 10). Typically the next stage in processing will be press work to form the profile of the circlip or ring.

The movement of the retractable blade 7 is controlled by vertically moving cam 27. Cam 27 has an inclined cam surface 29 which cooperates with cam follower surface 31 which is also inclined. The movement of the cam 27 in a vertical direction translates into horizontal movement in the direction of the arrows depicted in FIGS. 2 and 3 of the blade 7. The movement of the blade into its cutting position corresponds to an upwards movement of cam 27.

FIGS. 4 and 5 depict the apparatus in more detail but here the fixed blade 15 and the coil have been omitted for clarity.

The cutting station comprises a base 33 and four support posts 35. The base 33 includes four bores (not shown) for the posts 35 to mount them substantially vertically. The top of the posts 35 support top 37. This includes an opening 39 through which the cam 27 can be put into place. Four pins 41 extend upwards from the top 37 and are mounted in bores (not shown) in top 37. Slidably mounted upon the pins 41 via bushes 43 is cam holder 45 coupled to spigot 47. The movement of cam holder 45 on pins 41 is controlled by rams (not shown). The rams could be hydraulic or air operated. In this case a power press is used. The cam holder 45 includes a groove 49 which accommodate the head 51 of the cam 27 to hold it firmly in position. Clamp 53 serves to lock the cam 27 into position.

The housing top 37 includes an opening 55 into which die holder 57 can be clamped by clamp members 59. The die holder 57 includes two bores parallel to one another, Only one bore 61 is visible in the drawings. Into bore 61 is placed pin 63 which extends through top spring housing 65 and bottom spring housing 67 and through base plate 69. The base plate 69 includes a tapered bore 71 to allow a nut to be put in place to hold the housings together. The top and bottom spring housings each incorporate three bores 73 arranged in a triangular pattern so that two only of the bores are visible in the drawing for each housing. Within each bore 73 is mounted spring 75 and pin 77. The pin 77 has one planar face to maintain its movement in a linear direction without rotation. An end plate 79 forms a surface on which the spring 73 bears to urge the pin 77 in a direction towards the cam 27. In the drawing this direction is from left to right and is the direction referred to in the specification as forwards.

Between the top spring housing 65 and the bottom spring housing 67 is defined gap 81. In use the coil passes through gap 81. The pin 77 bears against blade roller housings 83 and 85. Each of the blade housings include a bore through which roller 19 passes so that movement of the housing causes movement of the roller 19. Each of the blade housings 83, 85 is L-shaped in cross section and the blade 7 fits between the housings 83 and 85. The inclined surface 31 of the blade 7 bears against The cam surface 29 of cam 27. The cam 29 passes through a slot in the base plate 69 and through support block member 87 shown in more detail in FIG. 5. Support member 87 is coupled to die block 57 by screws and dowels (not shown).

Support member 87 includes slot 89 shaped to accommodate fixed blade 15, blade housing 83 and cam 27. This is a vertical slot which passes through the whole member. The member 87 includes a lower portion 91 which provides an arcuate upper surface coupled to the rest of the block by shank 93 of a thickness equal to the thickness of blade 7. The member 87 is mounted such that the cut ring 23 when cut moves on to support 91 and moves along support 91 before being fed to further processing stations. Slot 95 is shaped and dimensioned such that blade housings 83 and 85 may slide within the slot. It serves to keep all parts in alignment. Slot 95 can be used to attach further support means for moving rings onto further stations. In this way a plurality of rings can be formed sequentially which are arranged parallel and aligned to one another.

Figure 7:
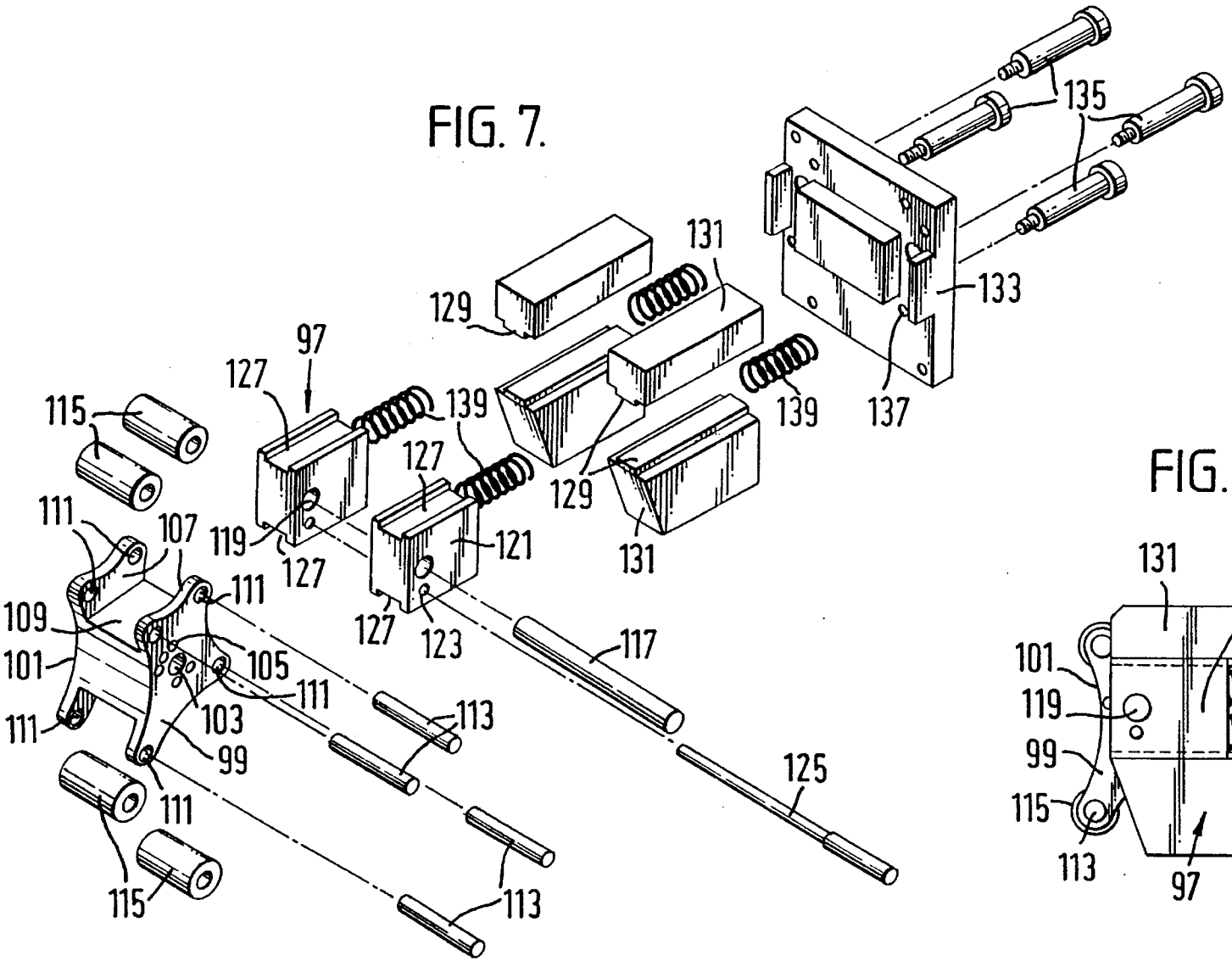
FIG. 7 is an exploded perspective view of gap straightening means.
Figure 8:
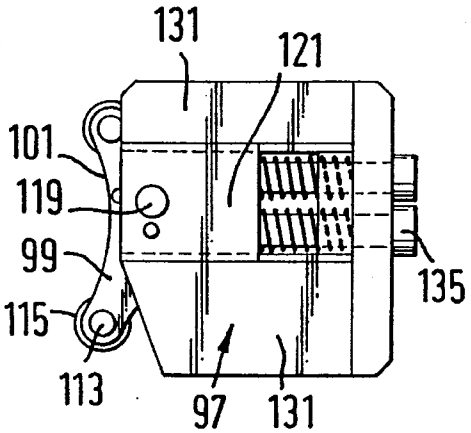
FIG. 8 is a side view of the gap straightening means of FIG. 7.

Omitted from FIGS. 1 to 5 is gap straightening means 97 illustrated in FIGS. 7 and 8. The approximate position of the gap straightening means is illustrated in FIG. 5.

The means 97 comprises roller block 99 including a series of radiused surfaces 101. The block 99 includes a central bore 103 surrounded by five locking bores 105.

The block 99 essentially comprises two parallel plate members 107 each having four bores 111 into which pins 113 pass. These serve as mounting shafts for opal grade carbide rollers 115 which sit between the plates 107.

The block 99 is rotatably mounted via shaft 117 which passes through bores 119 in two aligned roller block slides 121 and through central bore 103. Each roller block slide includes a locking bore 123 through which locking pin 125 passes.

Each roller block slide 121 includes an upper and lower groove 127 into which fit tongues 129 on respective upper and lower slide housings 131. The slide housings 131 are mounted to an end plate 133 by pins not shown.

Spring pins 135 pass through bores 137 in the end plate and springs 139 pass around them.

In use the slides 121 are slidably mounted with respect to the housings 131 and are urged away from the end plate 133 by springs 139.

The block 99 is rotated into a position where the desired surface 101 faces the coil and until an appropriate locking bore 105 is aligned with locking bore 123 of the slide, the locking pin 125 then locks the block into position between the slides 121.

The gap straightening means is mounted adjacent the coil such that the rollers 115 bear against the coil surface to hold them in position. The approximate position of mounting is indicated at 141 in FIG. 5. When a coil of different diameter is to be handled the roller block 99 is rotated to present a surface of different radius.

This urges the coil, and the cut rings into position where the gaps cut are aligned with the cam to allow the rings to be pushed in an axial direction.

In use, FIG. 4 is equivalent to the schematic view of FIG. 2 with the cam 27 in its lower most position and FIG. 5 corresponds to FIG. 3 with the cam in its upper most position.

In use, a mechanical ram pulls spigot 47 and member 45 upwards to slide on pins 41 to move the cam 27 upwards. The ram is a converted blanking press of capacity 6 tons. The cutting tonnage is greatly reduced by the cam action to about 2.4 tons. The action of the cam surface 29 on the cam follower surface 31 of the blade 7 pushes the blade 7 in a direction towards the coil to form a cut against fixed blade 15. The blade housings 83 and 85 thus move from their position shown in FIG. 4 to the position shown in FIG. 5 and pins 77 bear against springs 73. The ram then moves again and moves downwards from the position to allow the blade 7 to retract by the action of spring 73 on pin 77. The roller 19 moves with the housing and cause to push the freely cut end 25 past fixed blade 15 so that it coils quickly around blade 15 to abut face 5 of the blade 7.

In order to change the dimensions of the coil being cut, the cam 27 is changed by releasing clamps 53 and the die holder 57 is changed by releasing clamps 59.

The majority of parts are manufactured from steel but the fixed blade 15 and moving blade 7 are opal grade carbide.

It will be appreciated by the man skilled in the art that the angle of the inclined surface 29 and 31 will determine the relative movement of the cam 27 and the blade 7.

The apparatus can operate at speed from 20–30 circlips per minute to 400 circlips per minute.

Although possible to run the apparatus continuously, it has been found that a sensor 143 can be used to trigger the rams to operate the blade 7 when the coil abuts the stop 5. The sensor 143 has been illustrated schematically only in FIG. 1 since it can be situated in a number of positions in the cutting station 4. It may be mounted within the blade 7 to sense contact by a change in conductivity or at a point adjacent the coil to measure when the coil's movement is arrested. The sensor 143 is coupled to control means 145 which is typically a microprocessor to then effect operation of the ram to move the cam 27 and the blade 7. As will be apparent to the skilled addressee of the specification the microprocessor will typically be coupled to the coiling station 3 and further processing stations 10. Thus if for any reason there is any interruption of operation of any station the other stations can be controlled accordingly.

We claim:

1. Apparatus for forming a plurality of aligned rings from a length of wire, comprising:

means for introducing said wire to a coiling station to form a wire coil about a longitudinal axis and for feeding said coil in the direction of said axis from the coiling station;

a cutting station positioned downstream of the coiling station for receiving said coil, said cutting station including: (a) a stop engaged by a free end of the coil fed from the coil station, and (b) cutting means movable between cutting and non-cutting positions, said cutting means being sequentially operative, when a free end of the coil engages said stop, to move to its cutting position to cut a ring from the coil, said ring having a gap formed during cutting of the coil; and means operative when said cutting means is moved to its non-cutting position to displace the ring from the cutting station to support means having a portion shaped to enter the gap in said ring to control the orientation of each ring cut during the sequential operation of the cutting means thereby preventing tangling of the rings.

2. Apparatus according to claim 1, wherein said stop is formed so as to permit the ring to move past the stop once the ring has been cut.

3. Apparatus according to claims 1 or 2, wherein the cutting means includes a blade arranged to move in the direction of said longitudinal axis.

4. Apparatus according to claim 3, wherein said blade also serves as the stop.

5. Apparatus according to claim 3, wherein the coil is cut by shearing action between the movable blade and a fixed blade.

6. Apparatus according to claim 3, wherein movement of said blade is controlled by a cam created by the blade having an inclined cam follower surface which cooperates with an inclined surface of a cam which is movable in a direction perpendicular to said longitudinal axis.

7. Apparatus according to claim 5, further comprising a pusher member positioned adjacent the fixed blade and movable when the cutting means moves to the non-cutting position to push the free end of the coil past the fixed blade towards the stop.

8. Apparatus according to claim 5, further comprising a pusher member positioned adjacent the fixed blade and movable when the cutting means moves to the non-cutting position to push the free end of the coil past the fixed blade towards the stop.

9. Apparatus according to claim 6, wherein said blade also serves as the stop.

* * * * *

UNITED STATES PATENT AND TRADEMARK OFFICE

CERTIFICATE OF CORRECTION

PATENT NO. : 5,555,758

DATED : September 17, 1996

INVENTOR(S) : Ellison, et al

It is certified that error appears in the above-identified patent and that said Letters Patent is hereby corrected as shown below:

Column 8, line 9, "8. Apparatus according to claim 5,..." should read -- 8. Apparatus according to claim 6,... --

Signed and Sealed this

Third Day of February, 1998

*Attest:*

Bruce Lehman

BRUCE LEHMAN

*Attesting Officer*

*Commissioner of Patents and Trademarks*